United States Patent [19]

Holl

[11] Patent Number: 4,708,198

[45] Date of Patent: Nov. 24, 1987

[54] CONSTRUCTION AND METHOD FOR IMPROVING HEAT TRANSFER AND MECHANICAL LIFE OF TUBE-BUNDLE HEAT EXCHANGERS

[76] Inventor: Richard A. Holl, 1912 Four Seasons Dr., Burlington, Ontario, Canada, L7P 2Y1

[21] Appl. No.: 717,580

[22] Filed: Mar. 29, 1985

Related U.S. Application Data

[63] Continuation-in-part of Ser. No. 438,300, Nov. 1, 1982, abandoned.

[51] Int. Cl.[4] ..... F28F 13/12

[52] U.S. Cl. ..... 165/109.1; 165/159

[58] Field of Search ..... 138/38; 165/109.1, 174, 165/160, 161, 164, 165, 179, 185, 159

[56] References Cited

U.S. PATENT DOCUMENTS

| | | | |
|---|---|---|---|
| 1,313,624 | 8/1919 | Evans et al. | 165/109.1 |
| 2,070,427 | 2/1937 | Faunce | 165/174 X |
| 3,704,748 | 12/1972 | Hapgood | 165/179 X |
| 3,732,919 | 5/1973 | Wilson | 165/180 X |
| 3,921,712 | 11/1975 | Renzi | 165/165 |
| 4,443,389 | 4/1984 | Dodds | 165/179 X |

*Primary Examiner*—Albert W. Davis, Jr.
*Assistant Examiner*—Richard R. Cole
*Attorney, Agent, or Firm*—Francis J. Lidd

[57] ABSTRACT

An improved heat exchange construction for tube bundle heat exchange systems including shell (4) and tube (6) types (2), incorporating detached, essentially spherical flow interrupters (24, 26) arranged in an interconnected matrix configuration (22), and disposed within the tube bundle interstices (9, 11). Substantial improvements in heat exchange and exchanger tube life, is provided. The mechanically interconnected matrix configuration of the flow interrupters provides an economical and easily assembled means to improve heat transfer outside of individual tubes in a tube bundle configuration. Continuous tube support is also provided by tube-/interrupter contact, thereby greatly decreasing fatigue failures encountered in presently used multiple tube, tube/shell heat exchanger configurations (2).

10 Claims, 6 Drawing Figures

CONSTRUCTION AND METHOD FOR IMPROVING HEAT TRANSFER AND MECHANICAL LIFE OF TUBE-BUNDLE HEAT EXCHANGERS

CROSS REFERENCE TO RELATED APPLICATIONS

This application is a continuation-in-part of my copending application Ser. No. 06/438,300, filed on Nov. 1, 1982 now abandoned. The specification, claims, and any allowed amendments are hereby incorporated by reference.

BACKGROUND OF THE INVENTION

The following disclosure statement is made pursuant to the Duty of Disclosure imposed by law and formulated in 37 CFR 1.56(a). No representation is hereby made that information disclosed herein in fact can be considered prior art, since 37 CFR 1.56(a) includes a materiality concept which depends somewhat on certain inevitably subjective elements including much likelihood and reasonableness. Inasmuch as a growing attitude appears to require citation material which may lead to a discovery of more pertinent material, though not necessarily being of itself pertinent, the following comments contain conclusions and observations which have only been drawn from or become apparent after conception of the subject invention or comparisons contrasting the subject invention or its merits against the background of later developments.

This invention relates generally to heat exchangers employing tube bundles for transferring heat between fluids flowing inside the tubes to surrounding fluid outside the tube surfaces.

Heat exchangers employing tube bundles surrounded by flowing fluid outside the tubes, including a commonly used configuration known as a shell-and-tube, presently utilize staggered flow baffles to improve external tube heat exchange. A typical heat exchanger of this type is disclosed and claimed in U.S. Pat. No. 3,426,841.

The shell side baffles utilized in this construction extend from the upper and lower portions of the exchanger shell with the predetermined portion of the tube bundle passing through alternate baffles spaced along the tube flow length, and spanning a portion of the internal flow cross-section of the exchanger shell. This configuration essentially converts the longitudinal shell side flow to what can be called tube cross flow, by 180 degree reversals of the shell side fluid flow as it passes from one baffle to the other.

Heat exchangers of this construction, while providing satisfactory heat exchange, suffer from substantial difficulties, primarily due to large pressure drops caused by the baffle induced flow reversals, and relatively short tube bundle life due to flow vibration induced by shell side fluid cross flow. It is well known to those skilled in the heat exchanger art that cross flow turbulence occurring at flow rates great enough to improve external heat exchange results in mechanical tube vibration which often results in tube failure at the highest stress point, perforation of the tube at its intersection with the baffle, or failure of tube heat exchanger tube sheet interface.

A known heat exchanger construction as disclosed in U.S. Pat. No. 4,127,165, aimed at solving these problems, utilizes a substantial number of rods internal of the heat exchanger shell disposed around the tube axis, creating a rectangular tube support matrix. Exchanger tubes passing through somewhat essentially square apertures in this matrix provide support through direct contact for longitudinal tubes. The matrix also acts to increase or generate turbulence in the shell side flow.

This rod supported heat exchanger construction, while demonstrating improved performance over the more common tube baffle construction, suffers from substantial flow related difficulties. The turbulent flow vortices induced by the rod presence can result in a considerable amount of rod vibration, with attendant failures due to tube perforation at the rod/tube surface interface.

It is therefore an object of this invention to overcome the difficulties encountered in the above described heat exchangers by providing a shell and tube heat exchanger having a distributed tube support contained in the tube bundle interstices.

It is a further object of this invention to provide an improved shell/tube heat exchanger by incorporation of a plurality of flow interrupters arranged in a matrix configuration, thereby insuring positive positioning of flow interrupters within the tube bundle interstices, external of the heat exchange surfaces.

It is yet an additional object of this invention to provide a method of enhancing shell side heat transfer and extending life of the heat exchange tubes through installation of a connected matrix of flow interrupters and tube supports.

It is a further object of this invention to provide a method of improving existing heat exchanger performance through installation of preassembled flow interrupter and tube support in a matrix configuration.

SUMMARY OF THE INVENTION

The heat exchanger construction disclosed herein incorporates flow interrupters disposed in a predetermined pattern adjacent the external heat exchange surfaces of a tube bundle. The matrix configuration is generally determined by the particular tube geometry utilized, however, in the typical but not limiting embodiment disclosed, essentially spherical configuration of the interrupters improves heat exchange through flow interruption adjacent the exchanger tube surfaces. The predetermined three-dimensional spacing discussed, i.e. longitudinal and radial, provides increased shell side heat transfer at substantially less proportional shell side pressure drop than encountered in prior art exchangers.

Matrix construction of said flow interrupters additionally provides continuous two dimensional longitudinally disposed tube support which can be economically manufactured and installed.

DETAILED DESCRIPTION OF THE INVENTION

Figure 1:
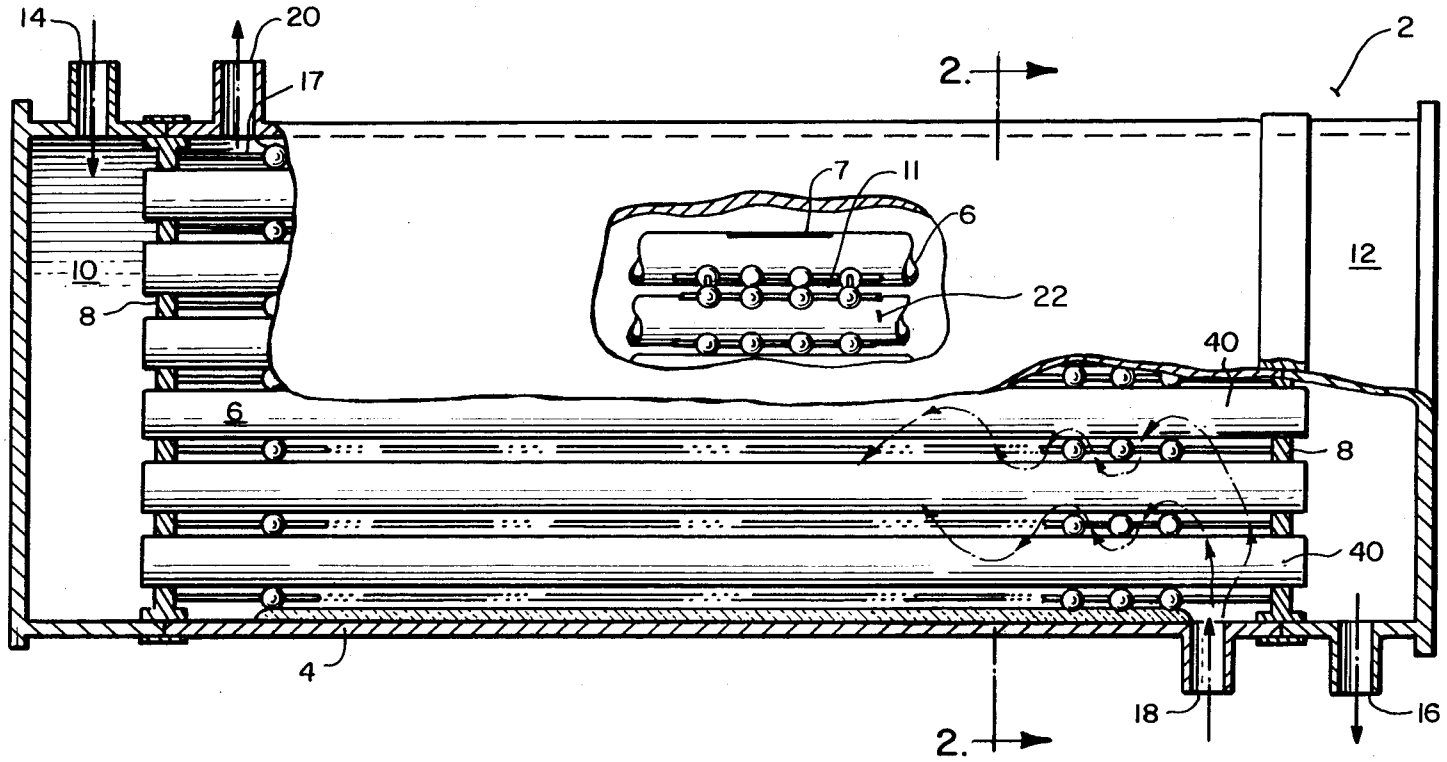
FIG. 1 shows a shell/tube heat exchanger in partial cross-section including a partial tear-away section of the heat exchange shell, particularly showing the location of flow interrupters and tube supports in the longitudinal direction, and adjacent location of tube-to-tube supports transverse to the tube axis.
Figure 2:
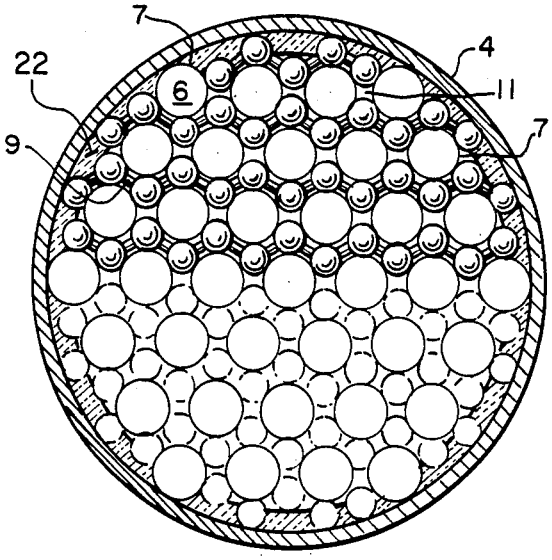
FIG. 2 is a cross-section along lines 2—2 of FIG. 1, particularly showing the interstitial nature of the matrix in a plane perpendicular to the tube axis.
Figure 3:
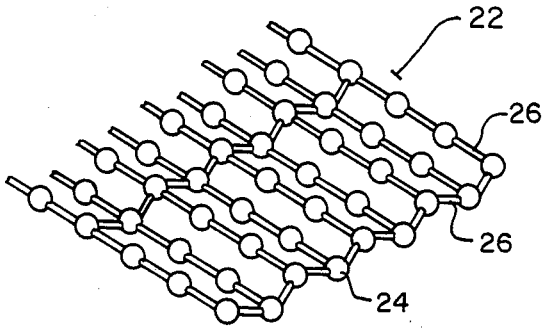
FIG. 3 is a partial perspective view of the flow interrupter matrix in a preferred embodiment.

With reference to FIGS. 1 and 2, in a preferred embodiment of the invention, there is a shell and tube heat exchanger assembly 2 having an outer shell 4. Internal of the shell 4, are generally circular internal tube sheets 8, dividing fluid tight terminations for a plurality of longitudinal tubes 6, wherein the tubes 6 terminate in an inlet manifold, collecting volume 10 in an outlet manifold or collecting volume 12. Each inlet and outlet manifold has an inlet nozzle 14, and an outlet nozzle 16. Further defined by the exchanger shell 4 and the tube sheets 8, is a shell side flow volume 17 containing the plurality of tubes 6. The shell flow volume 17 has a fluid inlet 18 and a fluid outlet nozzle 20.

The tube sheets 8 establish a tube spacing pattern, more particularly shown in FIG. 2, such that tube interstices or inter-tube flow volumes 9 and flow cross-sectional areas 11, are defined by the external surfaces 7 of the plurality of tubes 6.

In keeping with the invention, an interrupter matrix 22 is located generally within the tube interstices or flow volumes 9. The interrupter matrix 22 has a plurality of essentially spherical flow interrupters 24 connected to a grid-like pattern by projections 26.

Figure 4:
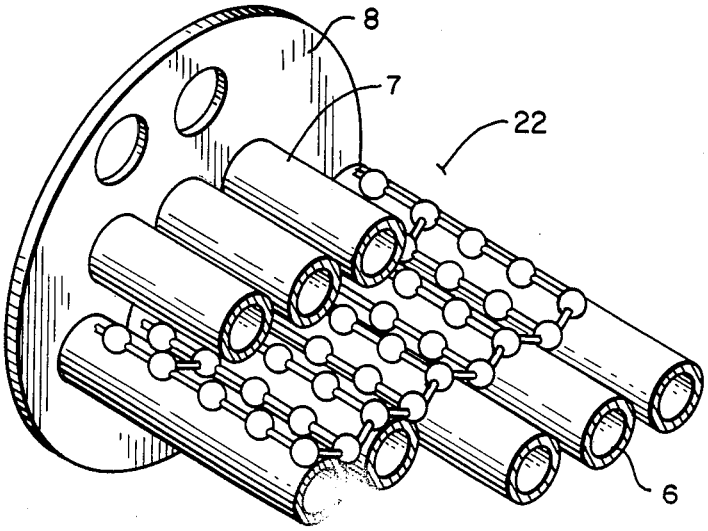
FIG. 4 is a partial perspective of a shell/tube heat exchanger particularly showing installation of the interrupter/support matrix between parallel tubes extending from tube sheet.

As shown in FIGS. 1 and 2 and more particularly the tear-away section of FIG. 1, the interrupter elements 24 are located internal of, or occupy the flow interstices 9 in a predetermined spatial arrangement including longitudinal an transverse patterns. This arrangement is best shown in the cross-sectional pattern of FIG. 2, and the partial section of FIG. 4.

In operation, separate fluids enter and exit ports 14, 16, respectively, and respectively 18, and 20 for heat transfer or other processing internal the exchanger. Flow through the tubes is, as those skilled in the heat exchanger arts will readily understand, typically apportioned among the plurality of tubes 6 as distributed in the pattern shown by FIG. 2. Shell side flow entering in port 18 and exiting the outlet port 20 is, however, interrupted by the presence of matrix assembly 22.

Figure 1A:
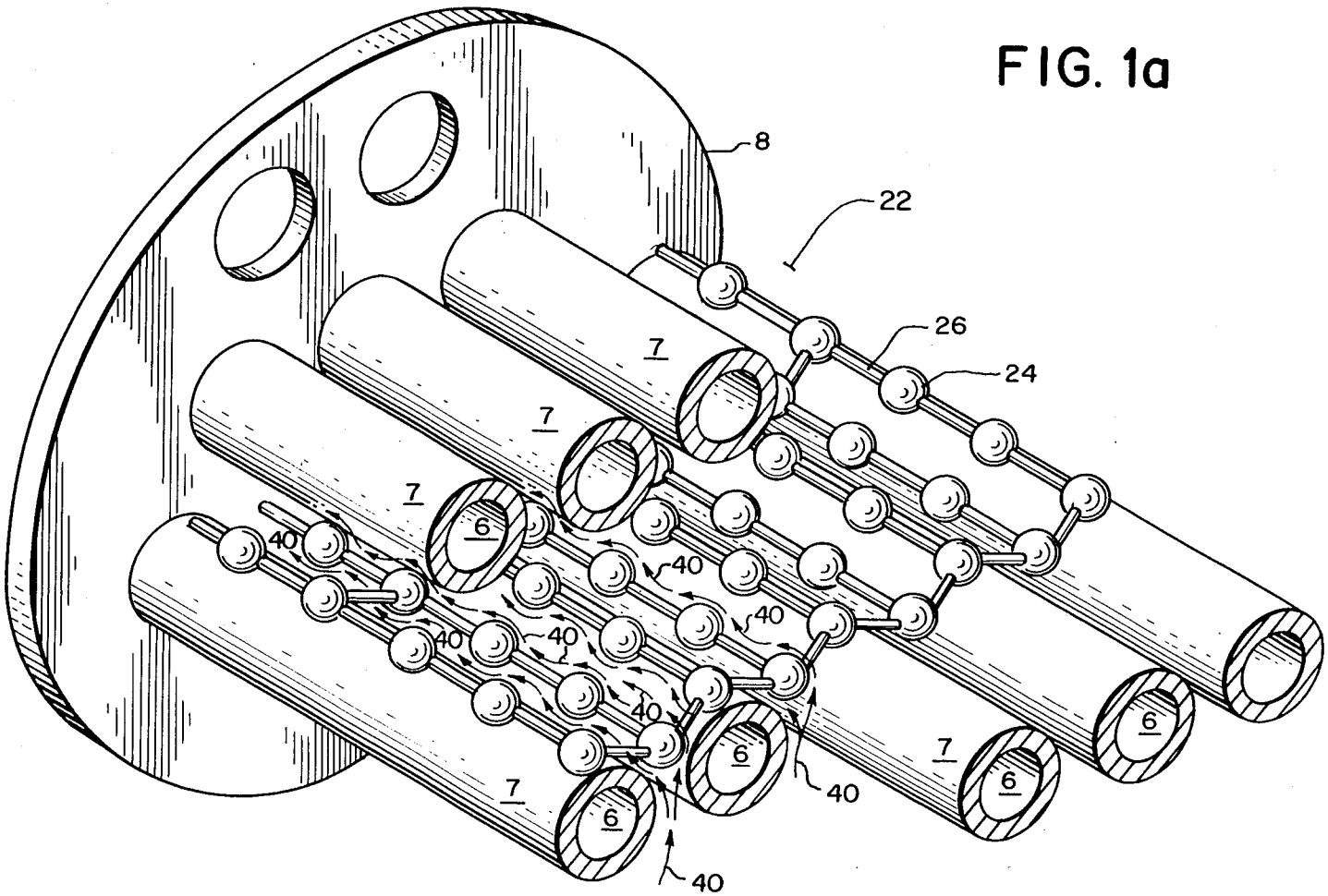
FIG. 1*a* is a partial perspective section of the heat exchanger of FIG. 1, showing the invention disclosed in place, more particularly showing fluid flow action of the interrupter matrix.

As shown by flow arrows 40, the presence of interrupter elements 24 held in place by the projections 26, establish generally longitudinal flow within the tube interstitial flow volumes 9. It should be noted that the interstitial flow volumes 9 are further divided by the presence of the matrix 22. Inter-tube flow is confined to a predetermined pattern of sequentially increasing and decreasing flow cross-sectional areas 9 and 11, (reference FIGS. 1, 1*a*, and 2), thereby establishing a generally undulating flow pattern closely adjacent to the outer tube surfaces 7 of the plurality of tubes 6. Applicant has discovered that, generally speaking, this undulating flow pattern results in greatly improved heat transfer without the pressure drop encountered when perpendicular baffles of prior art exchangers are used.

Applicant has further discovered that the undulating and generally longitudinal flow in the tube interstitial flow volumes 9, results in substantially reduced pressure drop for equivalent heat exchange when compared to exchangers utilizing cross-flow baffled construction. Applicant has also discovered that the presence of the flow interrupting matrix provides substantial distributed mechanical support between the tubes, resulting in greatly reduced flow and/or thermally induced tube vibration, a common source of the exchanger failure in prior art ex- changers.

Figure 5:
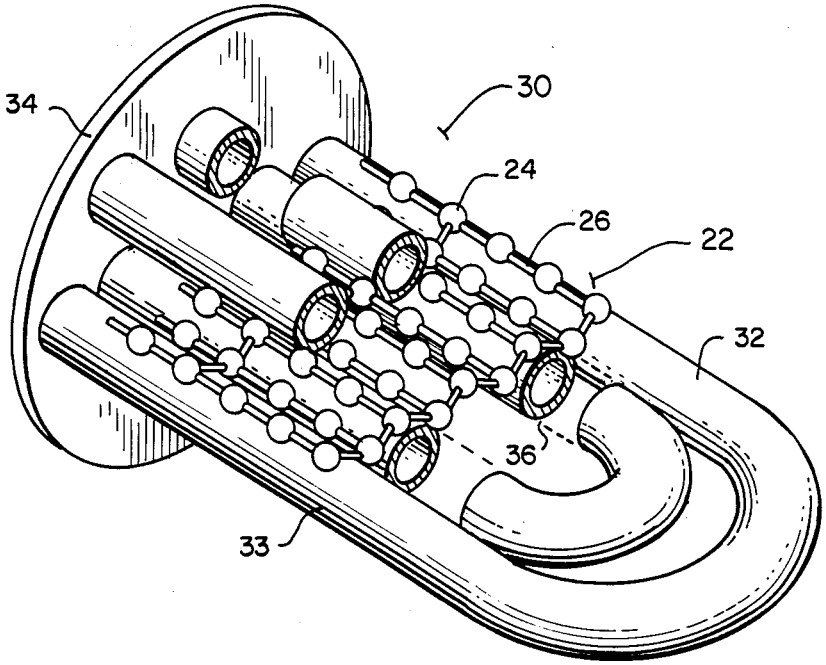
FIG. 5 is an additional partial perspective of a shell-/tube heat exchanger of the U-tube type, particularly showing the installation of the interrupter/support matrix.

FIG. 5 shows a partial perspective section of the invention of this application applied to a U-tube exchanger. As shown, a header 34 essentially supports a plurality of bent tubes 32 having an external surface 36. Positioned internal of the tube interstitial flow volumes as defined above, is an interrupter matrix assembly 22 having essentially spherical interrupters 24 connected by projections 26.

The interrupter matrix of this invention provides a convenient, modular, low-cost means for improving both heat exchange and life of multiple tube, tube and shell heat exchangers by providing generally longitudinal flow and mechanical support within the tube interstices without the use of support baffles.

Thus, it is apparent that there has been provided in accordance with the invention disclosed, a method and structure for improving thermal performance and mechanical life of tube bundle heat exchangers that fully satisfys the objects, aims and advantages set forth above. While the application of an interrupter matrix of the invention has been described in conjunction with specific embodiments thereof, including conventional shell and tube heat exchangers of the straight and bent tube types, it will be evident to those skilled in the heat exchange art that many alternatives, modifications and variations will be apparent in the light of the foregoing description. Accordingly, it is intended that the invention disclosed above shall embrace all such alternatives, modifications and variations as followed within the spirit and broad scope of the appended claims.

Therefore, I claim:

1. In a heat exchanger of the type utilizing a plurality of essentially longitudinal tubes carrying a first flowing fluid, and surrounded by a second flowing fluid for heat exchange therebetween, the improvement comprising;

a longitudinal tube bundle having individual tube axis arranged in a predetermined pattern, said tubes having inner and outer surfaces;

a plurality of interstitial fluid flow volumes defined by said tube outer surfaces, said volumes having first and second cross-sectional areas, and inlet and outlet ends;

a flow interrupting matrix disposed in said interstitial flow volumes, said matrix comprising a rectangular grid-like configuration having flow interrupters and members interconnecting said interrupters disposed across said first and second areas respectively, thereby defining third and fourth flow areas for carrying interrupted flow in said flow volumes;

means admitting fluid into and out of said inlet and outlet ends respectively;

wherein interrupted fluid flow passing through said flow volumes enhances heat exchange between said first and second fluids.

2. The improvement of claim 1 wherein said flow interrupting matrix comprises a rectangular grid-like configuration having essentially spherical elements interconnected by cylindrical elements of reduced diameter.

3. A method of improving the performance of heat exchangers utilizing a plurality of longitudinal fluid carrying tubes contained in a surrounding shell for transferring heat to a second flowing fluid in said shell, comprising the steps of;

establishing first and second interstitial flow areas, and interstitial flow volumes extending therefrom;

fabricating a flow interrupting matrix having interrupting elements and interconnecting members comprising a rectangular grid-like structure;

inserting said matrix with said interrupting and connecting elements occupying said first and second areas respectively, said matrix further extending into said flow volumes;

assembling said heat exchanger so as to contain said matrix within said area and flow volumes;

wherein fluid entering the shell of said exchanger passes through said flow cross-sections and flow volume in an interrupted manner thereby enhancing heat transfer between said tubes and the grid contained in said shell.

4. The method of claim 3 further comprising the step of fabricating a flow interrupting matrix having flow interrupting elements of essentially spherical shape in a first diameter and said connecting members having a cylindrical cross-section of substantially less diameter than said interrupting element.

5. In a heat exchanger of the type utilizing longitudinal tubes carrying a first flowing fluid, surrounded by a shell containing a second flowing fluid for heat exchange therebetween, the improvement comprising:

a longitudinal tube bundle having individual tube axis arranged in a predetermined pattern, said tubes including a heat exchanger wall having inner and outer surfaces for separating said fluids;

a plurality of interstitial fluid flow volumes defined by said tube outer surfaces, said volumes having first and second cross-sectional areas, and inlet and outlet ends;

a support matrix comprising a reactangular grid-like configuration in said flow volumes said matrix having discreet elements and inter-connecting members sequentially disposed in said volume, said elements in at least point contact with adjacent tube outer surfaces at said first cross-sectional area, and said interconnecting members disposed in said second cross-sectional area;

third and fourth flow areas defined by each said matrix element and interconnecting member;

whereby said element and tube external surface point contact provide distributed mechanical tube support, and said interconnecting members retain said matrix, thereby reducing inter-tube transient motion.

6. The heat exchanger of claim 5 wherein said element is essentially spherical and said interconnecting member is essentially cylindrical in cross section.

7. The exchanger of claim 5 wherein said matrix is planar and rectangular, and extends longitudinally in said exchanger shell, and transversely across each tube layer in said bundle.

8. A method of improving the life of heat exchangers utilizing a plurality of longitudinal tubes carrying a first fluid contained in a shell for transferring heat to a second fluid flowing in said shell, comprising the steps of;

establishing first and second flow volumes interstitial said tubes, and interstitial flow volumes extending therefrom;

fabricating a support matrix having discrete elements and interconnecting members forming a reactangular grid-like configuration;

disposing said matrix in said flow volumes such that each element is in at least point contact with adjacent tube external surfaces, thereby providing distributed support for the entire tube bundle.

9. The method of claim 8 wherein the step of fabricating further includes fabricating a rectangular matrix having spherical elements and cylindrical interconnecting members.

10. The method of claim 8 wherein the step of disposing further includes the step of inserting a planar matrix between at least two tube layers thereby providing longitudinal and transverse contact between the tubes of said layers.

* * * * *